US009533824B2

(12) United States Patent
Zhao et al.

(10) Patent No.: US 9,533,824 B2
(45) Date of Patent: Jan. 3, 2017

(54) PACKAGING BOX FOR LCD PANEL COMPONENTS

(71) Applicant: SHENZHEN CHINA STAR OPTOELECTRONICS TECHNOLOGY CO., LTD, Shenzhen (CN)

(72) Inventors: Zhilin Zhao, Shenzhen (CN); Shihhsiang Chen, Shenzhen (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 435 days.

(21) Appl. No.: 13/806,843

(22) PCT Filed: Nov. 22, 2012

(86) PCT No.: PCT/CN2012/085048
§ 371 (c)(1),
(2) Date: Dec. 25, 2012

(87) PCT Pub. No.: WO2014/075328
PCT Pub. Date: May 22, 2014

(65) Prior Publication Data

US 2014/0131240 A1 May 15, 2014

(30) Foreign Application Priority Data

Nov. 13, 2012 (CN) ..... 2012 1 0452582

(51) Int. Cl.
*B65D 85/48* (2006.01)

(52) U.S. Cl.
CPC ..... *B65D 85/48* (2013.01)

(58) Field of Classification Search
CPC ..... B65D 2571/00055; B65D 85/48; B65D 81/05; B65D 81/055; B65D 81/058; B65D 1/34; B65D 25/10; B65D 81/02; B65D 81/127
USPC ..... 206/451
See application file for complete search history.

(56) References Cited

U.S. PATENT DOCUMENTS

| | | | | |
|---|---|---|---|---|
| 2,464,153 | A * | 3/1949 | Robinson, Jr. | 206/451 |
| 2007/0053146 | A1 | 3/2007 | Lee et al. | |
| 2011/0226711 | A1 | 9/2011 | Okanishi et al. | |

FOREIGN PATENT DOCUMENTS

| | | | |
|---|---|---|---|
| CN | 101070110 A | | 11/2007 |
| CN | 101723137 A | | 6/2010 |
| CN | 201756276 U | * | 3/2011 |
| CN | 202244735 U | | 5/2012 |

* cited by examiner

*Primary Examiner* — Anthony Stashick
*Assistant Examiner* — James M Van Buskirk

(57) ABSTRACT

A packaging box for liquid crystal display (LCD) panel components includes a body. A sidewall of the body is configured with a neck. The packaging box further includes clamping pieces. Each of the clamping pieces comprises a first arm, a second arm, and a connecting structure that connects the first area to the second arm. The first arm is inserted into the neck. The second arm is inserted into a gap formed by separation of the LCD panel and the circuit board by a flexible circuit board. The LCD panel is in a completely fixed position in a horizontal direction.

11 Claims, 4 Drawing Sheets

PACKAGING BOX FOR LCD PANEL COMPONENTS

TECHNICAL FIELD

The present disclosure relates to the field of packaging, and more particularly to a packaging box for liquid crystal display (LCD) panel components.

BACKGROUND

Electronic products have various characteristics such as being complex, having a high value, and are updated often. Complicated supply relationships exist among manufacturers. For a typical production and marketing of the electronic products, production of parts, and an assembly of finished products and semi-finished products, are almost always conducted in different places and done by different manufacturers. Thus, the parts and the semi-finished products of the electronic products have to be transported among the manufacturers.

Taking a liquid crystal display (LCD) industry as an example, as shown in FIG. 1, the LCD panel components 1 includes an LCD panel 11, a circuit board 12, and a flexible circuit board 13 connected to the LCD panel 11 and to the circuit board (printed circuit board (PCB)) 12. The flexible circuit board 13 separates the LCD panel 11 from the circuit board 12 by a gap 14. In the prior art, the LCD components are generally horizontally placed in a packaging box made of polypropylene plastic foam (EPP) during transportation. Generally, a length of the circuit board is less than a length of the LCD panel. Thus, a body of the packaging box has a fixed position and uses buffers on four sidewalls of the LCD panel. However, when the length of the circuit board is close to the length of the LCD panel, only three sidewalls of the box comprise the buffer to protect only three sidewalls of the LCD panel, which may not protect the flexible circuit board if the flexible circuit board is arranged on the sidewall of the box without the buffer. When the box is vibrated, the circuit board is easy to be displaced and may pull off the flexible circuit board, resulting in damage to circuits of the flexible circuit board. In addition, as the flexible circuit board is a film, the circuit board may enter into a gap between two LCD panels due to the vibration, causing a glass panel of the LCD panel to break.

SUMMARY

In view of the above-described problems, the aim of the present disclosure is to provide a packaging box for a liquid crystal display (LCD) panel components with better protection performance.

The technical scheme of the present disclosure is that: A packaging box for LCD panel components. The LCD panel components has an LCD panel, a flexible circuit board, and a circuit board. The flexible circuit board separates the LCD panel from the circuit board by a gap. The packaging box comprises a body. A side wall of the body is configured with a neck. The packaging box further comprises clamping pieces. Each of the clamping pieces comprises a first arm, a second arm, and a connecting structure that connects the first arm to the second arm. The first arm is inserted into the neck of the sidewall of the body. The second arm is inserted into the gap. The second arm of each of the clamping pieces is also configured with a buffering piece. The buffering piece contacts with the side wall of the LCD panel. A bottom of the body is also configured with a neck. The second arm is inserted into the neck of the bottom of the body. There are multiple clamping pieces. Moreover, the clamping pieces are mutually parallel. The packaging box further comprises buffering sheets. The buffering sheets are arranged among LCD components and on a top of the LCD components. The buffering sheets define through holes that receive the second arm on the clamping pieces. The clamping pieces are U-shaped structures. The first arm and the second arm of each of the clamping pieces stretch across the circuit board. The clamping pieces are metal sheets or plastic pieces. A cross-sectional shape of each of the clamping pieces is a rectangular.

Another technical scheme of the present disclosure is that: A packaging box for LCD panel components. The LCD panel components has an LCD panel, a flexible circuit board, and a circuit board. The flexible circuit board separates the LCD panel from the circuit board by a gap. The packaging box comprises a body. A sidewall of the body is configured with a neck. The packaging box further comprises clamping pieces. Each of the clamping pieces comprises a first arm, a second arm and a connecting structure that connects the first arm to the second arm. The first arm is inserted into the neck. The second arm is inserted into the gap.

In one example, the second arm of each of the clamping pieces is also configured with a buffering piece. The buffering piece contacts with the sidewall of the LCD panel to increases a buffering performance of the buffering piece.

In one example, there are multiple clamping pieces. The clamping pieces are mutually parallel. Thus, a contact area with the sidewall of the LCD panel can be increased to reduce influence of the clamping pieces on the LCD panel.

In one example, the packaging box further comprises buffering sheets arranged among LCD panel components and on a top of the LCD panel components. The buffering sheets define through holes to receive the second arm on the clamping pieces. The buffering sheets can prevent mutual friction among LCD panels.

In one example, the clamping pieces are U-shaped structures.

In one example, the first arm and the second arm of each of the clamping pieces stretch across the circuit board.

In one example, the first arm and the second arm of each of the clamping pieces stretch across the LCD panel.

In one example, the clamping pieces are metal sheets or plastic pieces to ensure an adequate positioning function on the LCD panel.

In one example, a cross-sectional shape of each of the clamping pieces is rectangular. Thus, a contact area with the sidewall of the LCD panel can be increased to reduce influence of the clamping pieces on the LCD panel.

The present disclosure has the advantages that: The packaging box of the LCD panel components comprises clamping pieces. Each of the clamping pieces comprises a first arm, a second arm, and a connecting structure to connect the first arm to the second arm. The first arm is inserted into the neck of the sidewall of the body. Thus, the clamping pieces are simply fixed. The second arm is inserted into a gap formed by separation of the LCD panel and the circuit board by the flexible circuit board so that the second arm is in a fixed position in the sidewall of the LCD panel configured with the flexible circuit board. Other three sidewalls of the LCD panel are in a fixed position by the side wall of the body so that the LCD panel is complete in a fixed position in a horizontal direction. When the body is vibrated, a relative displacement between the LCD panel and the circuit board can be effectively reduced, thus avoiding pulling off the flexible circuit board and effectively protecting the circuits of the flexible circuit board. In addition, the circuit board is blocked by the clamping pieces and may not enter into a gap between two LCD panels, thus avoiding breaking a glass panel of the LCD panel.

DETAILED DESCRIPTION

Figure 1:
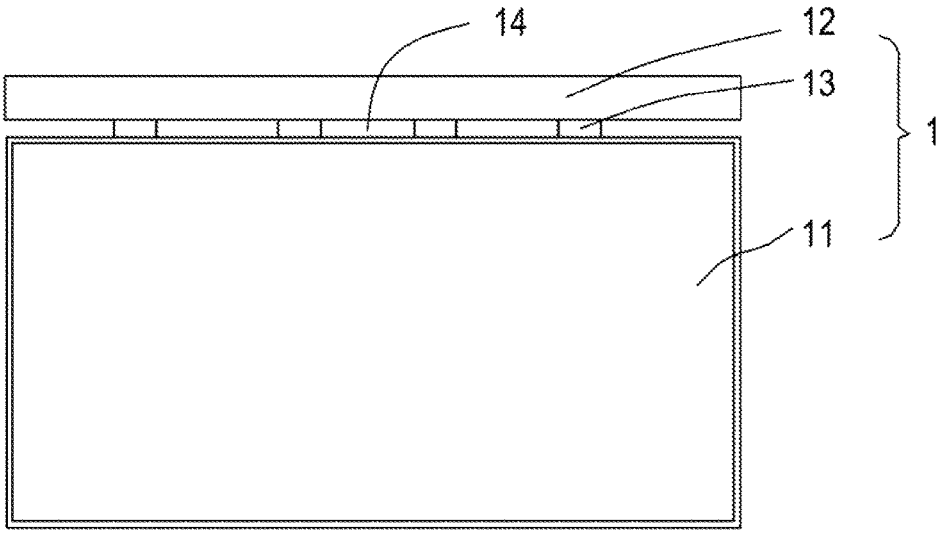
FIG. 1 is a structural diagram of components of a liquid crystal display (LCD) panel component.
Figure 2:
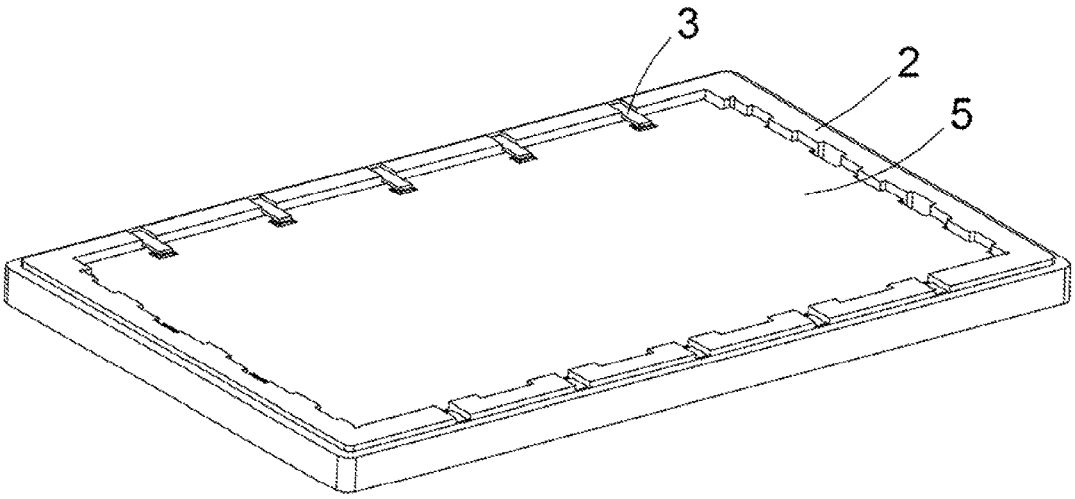
FIG. 2 is a structural diagram of a first example of a packaging box for liquid crystal display (LCD) panel components of the present disclosure.
Figure 3:
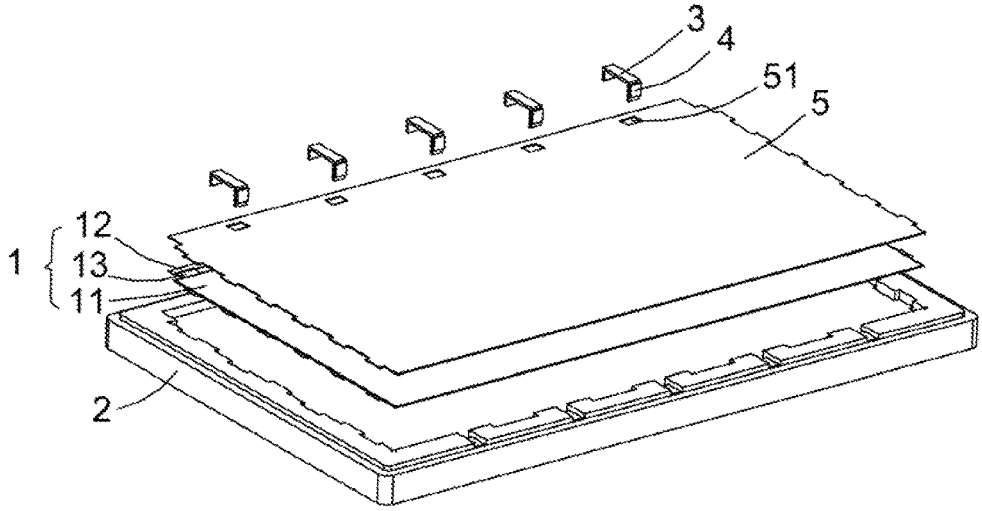
FIG. 3 is a disassembly diagram of a first example of a packaging box for the liquid crystal display (LCD) panel components of the present disclosure.
Figure 4:
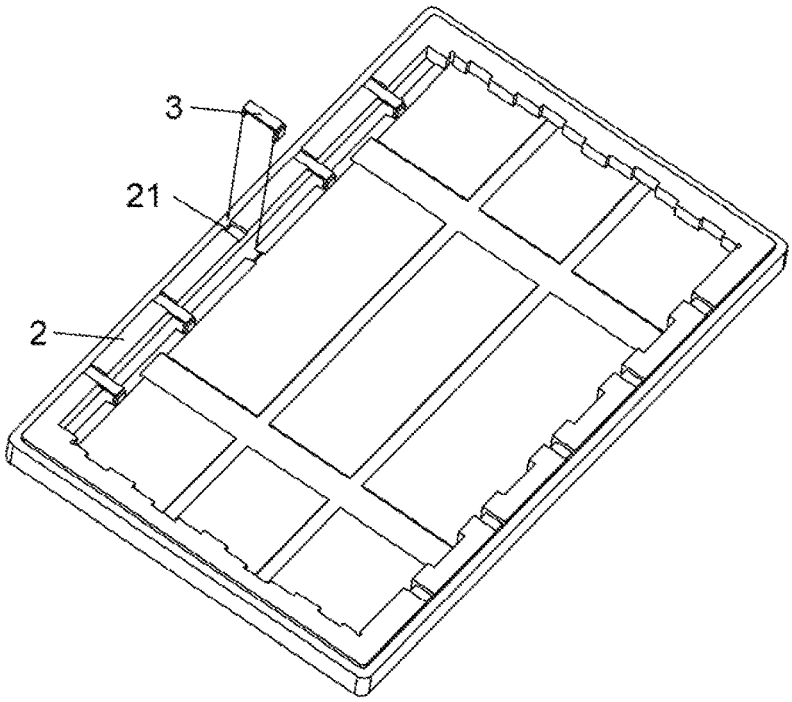
FIG. 4 is a disassembly diagram of another angle of a first example of a packaging box for the liquid crystal display (LCD) panel components of the present disclosure.
Figure 5:
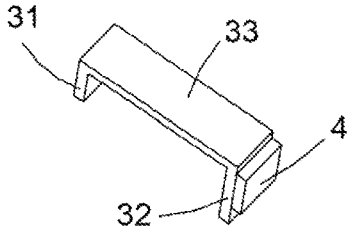
FIG. 5 is a structural diagram of a clamping piece in FIG. 2.

The present disclosure discloses a packaging box for liquid crystal display (LCD) panel components comprising LCD panel components 1 as shown in FIG. 1. As a first example of the packaging box of the present disclosure, as shown in FIG. 2 to FIG. 5, the packaging box comprises a body 2. A sidewall of the body 2 is configured with a neck 21. The packaging box further comprises clamping pieces 3. Each of the clamping pieces 3 comprises a first arm 31, a second arm 32, and a connecting structure 33 that connects the first arm 31 to the second arm 32. The clamping pieces 3 are U-shaped structures. The first arm 31 and the second arm 32 of each of the clamping pieces stretch across a circuit board 12. The first arm 31 is inserted into the neck 21 of the sidewall of the body 2. The second arm 32 is inserted into a gap 14 formed by separation of the LCD panel and the circuit board 12 by a flexible circuit board.

In the example, there are multiple clamping pieces 3. Moreover, the clamping pieces 3 are mutually parallel. Thus, a contact area between the clamping pieces and the sidewall of the LCD panel can be increased. In addition, a cross-sectional shape of each of the clamping pieces 3 is rectangular. Similarly, the contact area between the clamping pieces and the sidewall of the LCD panel can be increased to reduce influence of the clamping pieces on the LCD panel.

Although a cross-sectional shape of each of the clamping pieces can be selected freely, if the cross-sectional shape of each of the clamping pieces is circular, the contact area between the clamping pieces and the sidewall of the LCD panel is in linear contact, therefore, an overlarge local impact pressure on the LCD panel may cause a glass panel of the LCD panel to break. As a result, the second arm of each of the clamping pieces is sleeved with a buffering sheath made of a soft material.

The packaging box of the LCD panel components of the present disclosure comprises the clamping pieces 3. Each of the clamping pieces 3 comprises a first arm 31, as second arm 32, and a connecting structure 33 that connects the first arm to the second arm. The first arm 31 is inserted into the neck 21 on the sidewall of the body and the clamping pieces 3 are fixed. The second arm 32 is inserted into the gap 14 so that the second arm 32 is in a fixed position in a sidewall of the LCD panel 11 configured with a flexible circuit board 13. Other three sidewall of the LCD panel 11 are in a fixed position by the sidewall of the body 2 so that the LCD panel is completely in a fixed position in a horizontal direction. When the body 2 is vibrated, a relative displacement between the LCD panel 11 and the circuit board 12 can be effectively reduced, thus avoiding pulling off the flexible circuit board 13 and effectively protecting circuits of the flexible circuit board. In addition, the circuit board 12 is blocked by the clamping pieces 3 and cannot enter into a gap between two LCD panels, thus avoiding breaking a glass panel of the LCD panel.

In the example, the packaging box further comprises buffering sheets 5. The buffering sheets 5 are arranged among the LCD panel components 1 and on the top of the LCD panel components 1. The buffering sheets 5 define through holes 51 to receive the second arm 32 on each of the clamping piece. The buffering sheets 5 can prevent mutual friction among LCD panels.

In the example, in order to ensure an adequate fixed positioning on the LCD panel, hard metal sheets or plastic pieces are preferably selected as the clamping pieces 3. To increase buffering performance of the clamping pieces 3, a buffering piece 4 is arranged on the second arm 32 of each of the clamping pieces 3. The buffering piece 4 contacts with the sidewall of the LCD panel 11. Materials that have good buffering performance such as foaming material, rubber, or silica gel material can be selected as materials for the buffering piece 4. The buffering piece 4 can be bonded to the second arm 32 of each of the clamping pieces by an adhesive, or sleeved to the second arm 32.

Figure 6:
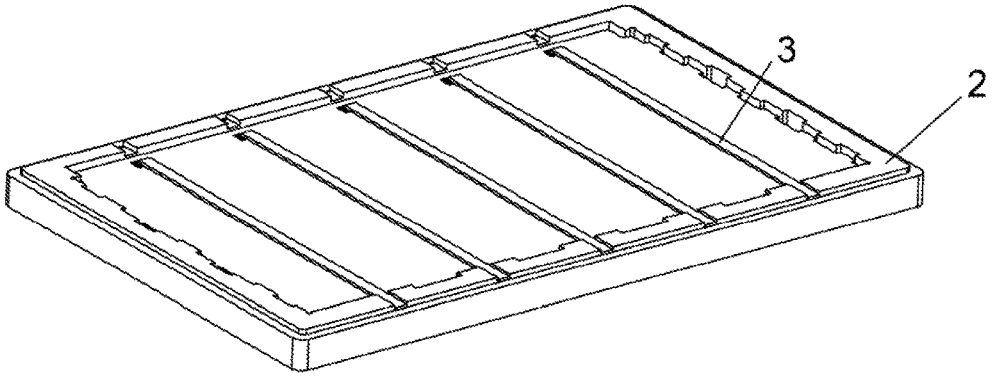
FIG. 6 is a structural diagram of a second example of a packaging box for the liquid crystal display (LCD) panel components of the present disclosure.
Figure 7:
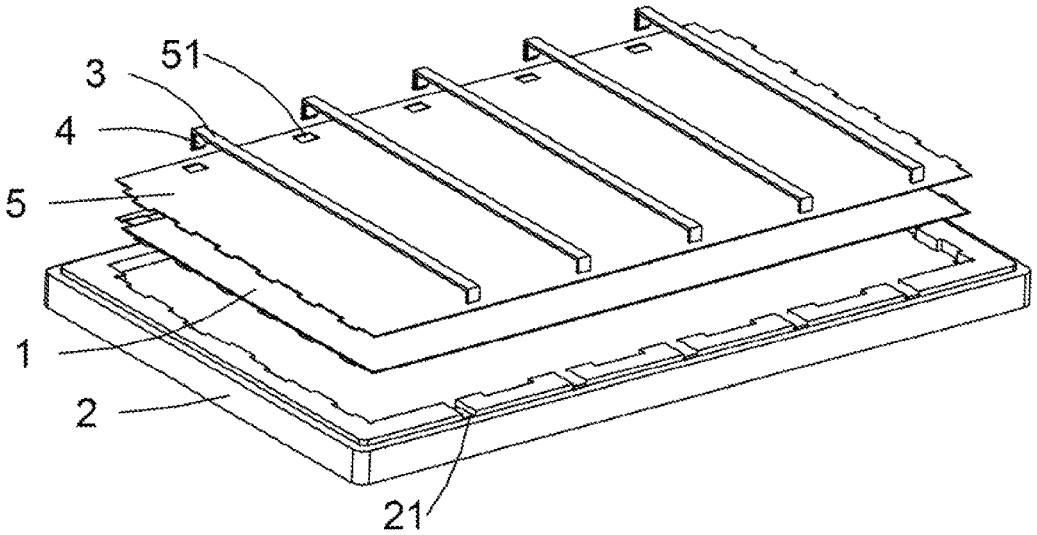
FIG. 7 is a disassembly diagram of a second example of a packaging box for the liquid crystal display (LCD) panel components of the present disclosure.
Figure 8:
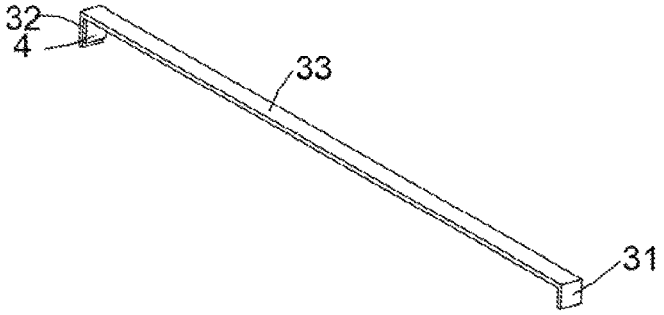
FIG. 8 is a structural diagram of a clamping piece in FIG. 6.

As the second example of the packaging box of the LCD panel components of the present disclosure, as shown in FIG. 6 to FIG. 8, the second example is different from the first example in that the first arm 31 and the second arm 32 of each of the clamping pieces cross a length of width of the LCD panel 11. Because the clamping pieces 3 are longer, stability of the clamping pieces 3 is reduced only by the cooperation between the first arm 31 and the neck 21 of the sidewall of the body. Because other structures and advantages are the same as the first example, the second example does not give unnecessary details.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A packaging box for liquid crystal display (LCD) panel components; the packaging box comprising a body, wherein a sidewall of the body is configured with a neck;

multiple clamping pieces, wherein each of the clamping pieces comprises a first arm, a second arm, and a connecting structure that connects the first arm to the second arm; wherein the first arm is inserted into the neck of the sidewall of the body; the second arm is inserted into a gap between a circuit board and an LCD panel of LCD panel components; the second arm of each of the clamping pieces is configured with a buffering piece that contacts with the sidewall of the LCD panel; wherein the clamping pieces are mutually parallel; and buffering sheets arranged among the LCD components and on a top of the LCD components; the buffering sheets defining through holes that receive the second arm on each of the clamping pieces; the clamping pieces are U-shaped structures; the first arm and the second arm of each of the clamping pieces stretches across the circuit board of LCD panel components; the clamping pieces are metal sheets or plastic pieces; a cross-sectional shape of the clamping pieces is rectangular.

2. A packaging box for liquid crystal display (LCD) panel components; the packaging box comprising a body; a sidewall of the body is configured with a neck; and clamping pieces; each of the clamping pieces comprises a first arm, a second arm and a connecting structure that connects the first arm to the second arm; the first arm is inserted into the neck of the sidewall of the body; the second arm is inserted into a gap between a circuit board and an LCD panel of LCD panel components.

3. The packaging box of the liquid crystal display (LCD) panel components of claim 2, wherein the second arm of each of the clamping pieces is configured with a buffering piece that contacts with the sidewall of the LCD panel.

4. The packaging box of the liquid crystal display (LCD) panel components of claim 2, wherein the number of the clamping pieces are multiple; the clamping pieces are mutually parallel.

5. The packaging box of the liquid crystal display (LCD) panel components of claim 2, wherein the packaging box further comprises buffering sheets; the buffering sheets are arranged among the LCD panel components and on a top of the LCD panel components; the buffering sheets defines through holes to receive the second arm on each of the clamping pieces.

6. The packaging box of the liquid crystal display (LCD) panel components of claim 2, wherein the clamping pieces are U-shaped structures.

7. The packaging box of the liquid crystal display (LCD) panel components of claim 2, wherein the first arm and the second arm of each of the clamping pieces stretch across the circuit board.

8. The packaging box of the liquid crystal display (LCD) panel components of claim 2, wherein the first arm and the second arm of each of the clamping pieces stretch across the LCD panel.

9. The packaging box of the liquid crystal display (LCD) panel components of claim 2, wherein the clamping pieces are metal sheets or plastic pieces.

10. The packaging box of the liquid crystal display (LCD) panel components of claim 2, wherein a cross-sectional shape of each of the clamping pieces is rectangular.

11. A packaging box for a liquid crystal display (LCD) panel components, the packaging box comprising a body; a sidewall of the body is configured with a neck; and clamping pieces; each of the clamping pieces comprises a first arm, a second arm and a connecting structure that connects the first arm to the second arm; the first arm is inserted into the neck of the sidewall of the body.

* * * * *